US005534897A

United States Patent [19]

Anderson et al.

[11] Patent Number: 5,534,897

[45] Date of Patent: Jul. 9, 1996

[54] INK JET MAINTENANCE SUBSYSTEM

[75] Inventors: David G. Anderson, Ontario; Alfred J. Claflin, Fairport, both of N.Y.

[73] Assignee: Xerox Corporation, Stamford, Conn.

[21] Appl. No.: 84,095

[22] Filed: Jul. 1, 1993

[51] Int. Cl.[6] ..... B41J 2/165

[52] U.S. Cl. ..... 347/32

[58] Field of Search ..... 346/134; 347/29, 347/30, 32, 23

[56] References Cited

U.S. PATENT DOCUMENTS

| | | | |
|---|---|---|---|
| 4,567,494 | 1/1986 | Taylor | 346/140 R |
| 4,590,482 | 5/1986 | Hay et al. | 347/19 |
| 4,731,639 | 3/1988 | Gutmann et al. | 347/32 X |
| 4,734,718 | 3/1988 | Iwagami et al. | 346/140 R |
| 4,947,187 | 8/1990 | Iwagami | 346/1.1 |
| 4,947,191 | 8/1990 | Nozawa et al. | 347/30 |
| 4,990,932 | 2/1991 | Houston | 346/75 |
| 5,040,000 | 8/1991 | Yokoi | 347/30 |
| 5,051,761 | 9/1991 | Fisher et al. | 346/140 R |
| 5,055,861 | 10/1991 | Murayama et al. | 347/32 |
| 5,065,170 | 11/1991 | Rezanka et al. | 346/140 R |
| 5,103,244 | 4/1992 | Gast et al. | 346/1.1 |
| 5,117,244 | 5/1992 | Yu | 346/140 R |
| 5,184,147 | 2/1993 | MacLane et al. | 346/1.1 |
| 5,206,666 | 4/1993 | Watanabe et al. | 347/32 |
| 5,257,044 | 10/1993 | Carlotta et al. | 347/32 |
| 5,270,738 | 12/1993 | Takahashi et al. | 347/29 |

FOREIGN PATENT DOCUMENTS

| | | | |
|---|---|---|---|
| 3-234649 | 10/1991 | Japan | 347/23 |

*Primary Examiner*—Benjamin R. Fuller
*Assistant Examiner*—Alrick Bobb
*Attorney, Agent, or Firm*—Oliff & Berridge

[57] ABSTRACT

An ink jet maintenance system having a translatable maintenance station carriage assembly including priming nozzles, wipers and drop detection hardware for translating across the width of the front nozzle face of one or more full-width array (FWA) printbars. The system includes an FWA printbar that is pivotally articulated between a print position and a maintenance position. An articulating cap assembly facilitates capping of ink jet printbar nozzles when the maintenance station carriage assembly moves to a home position outside the edge of the printbar and provides a free space area that allows translation of the maintenance station assembly when spaced away from the printbar.

17 Claims, 7 Drawing Sheets

INK JET MAINTENANCE SUBSYSTEM

BACKGROUND OF THE INVENTION

1. Field of the Invention

The invention relates to an ink jet maintenance system for a full width array (FWA) thermal ink jet printer. The system has a translatable maintenance station carriage assembly including priming nozzles, wipers and drop detection hardware for translating across the width of the front nozzle face of one or more fullwidth array (FWA) printbars. The FWA printbars are pivotally articulated between a print position and a maintenance position. An articulating cap assembly facilitates capping of printbar nozzles when the maintenance station carriage assembly is at a home position outside the edge of the printbar. When the cap assembly moves away from the printbar, a free space area is provided that allows unrestricted translation of the maintenance station assembly.

2. Description of Related Art

Maintenance subsystems in thermal ink jet printers have the following functions: purging, wiping, priming, drop sensing and capping. Viscous ink usually accumulates at the end of nozzles within a moving printhead or a stationary nozzle array. The accumulation is caused by evaporation of volatile components from the ink/air interface at the end of the nozzle.

Purging involves firing waste drops of ink to eject any such viscous ink at the end of the nozzle. Purging is required during interdocument zones due to the need to keep unused jets "fresh" during long document runs. Because there is a need for large amounts of purging over time, a waste gutter under the printbars is required to accommodate the waste ink. Alternative accommodation for waste ink can include spitting through openings in the paper transport belt or purging onto the belt and subsequent cleaning.

Wiping operations are usually performed by a wiper blade that moves relative to the front face of the nozzles to wipe off any residual ink from the front face of the nozzles. Vacuum priming usually involves applying a vacuum to the nozzle ends at the front face of the printhead or printbar. Capping of the ends of the nozzles involves placing a cap, consisting of an interior cavity and a perimeter seal, around the printer nozzles providing an airtight seal with the front face, keeping the nozzles from drying out. A preferred construction of a cap is that of a humidified cap having a maintenance fluid, water plus a biocide, contained within the interior cavity of the cap.

Drop sensing mechanisms can also be provided. Drop sensors are used to detect the presence of the drops after maintenance wiping and priming functions. Electronic circuitry may also be provided to sense the current drawn by the thermal ink jet heaters. If the current to the heater is within acceptable limits, the element is assumed to be electrically good and a missing drop is assumed to be due to a nozzle blockage. In this case, a second or subsequent maintenance cycle is initiated, perhaps at a reduced maintenance carriage speed. This cycle is repeated until all nozzles are firing drops or until a predetermined number of cycles has been completed. In the latter, a service action may be issued. A service action may also be issued if the current detector detects an open circuit heater or excess current draw.

Most known maintenance stations for full width array printers are located opposite a printbar array, but have an endless belt located between the maintenance station and the front nozzle face of the printbar array. This usually requires at least one opening in the endless belt. The opening must be aligned with the nozzle face and the belt must be stopped to allow initiation of maintenance operations.

Examples of these types of known art are U.S. Pat. Nos. 5,051,761 and 5,117,244, both assigned to Xerox Corporation. These references utilize a fixed FWA array and both have disadvantages. One has limited maintenance station component sizing and operation due to space restraints within the endless belt structure. The other cannot provide wiping or vacuum priming and requires use of the endless belt and magnetic forces to provide capping.

There is a need for a maintenance system that can provide reliable maintenance of a printbar or multiple printbars such as a full-width array (FWA) printbar. There also is a need for a maintenance system that can translate across a front face of a FWA printbar without interfering with a document platen, belt or any other structure that is located in front of the printbar during normal printing operation.

OBJECTS AND SUMMARY OF THE INVENTION

It is an object of the invention to facilitate reliable maintenance of FWA printbars.

It is another object of the invention to facilitate rotation of a FWA printbar to a maintenance position and to perform maintenance operations—wiping, vacuum priming, capping or drop sensing—on the FWA printbar without interfering with other printer components.

The above and other objects are achieved by providing a printing and maintenance system for an ink jet printer, comprising:

- a printbar including a planar nozzle face of a predetermined width pivotally mounted in the printer for movement about a horizontal pivot axis between a print position and a maintenance position, the maintenance position being angularly displaced from the print position;
- a cap member for capping the front nozzle face, the cap member being positionable between a first position spaced from the front nozzle face and a second position in direct engagement with the front nozzle face, the first position providing a predetermined free space area directly in front of the front nozzle face when the printbar is in the maintenance position; and
- a maintenance station translatable along a plane parallel to the planar nozzle face through the free space area when the printbar is in the maintenance position.

The maintenance station can include maintenance devices such as a wiper blade, a vacuum nozzle, a drop sensor, or combinations thereof. A largest dimension of the maintenance station, perpendicular to the plane, is smaller than the dimension of the free space area perpendicular to the plane, allowing the maintenance station unrestricted movement through the free space area. The maintenance station preferably translates at least across the entire width of the printbar front nozzle face.

To accommodate maintenancing of the printbar, without interfering with other components such as a document platen or belt, the maintenance station is in a location offset from the front nozzle face during printing operations. This location can be either above, below or behind the printbar. However, when maintenance is desired, the FWA printbar or printbar array is rotatable about a pivot axis to pivot the front nozzle face of the printbar away from a printing position and into a maintenance position. In the maintenance position, the front nozzle face is located parallel with and facing the maintenance station.

BRIEF DESCRIPTION OF THE DRAWINGS

The invention will be described in detail with reference to the following drawings wherein.

DETAILED DESCRIPTION OF PREFERRED EMBODIMENTS

Figure 1:
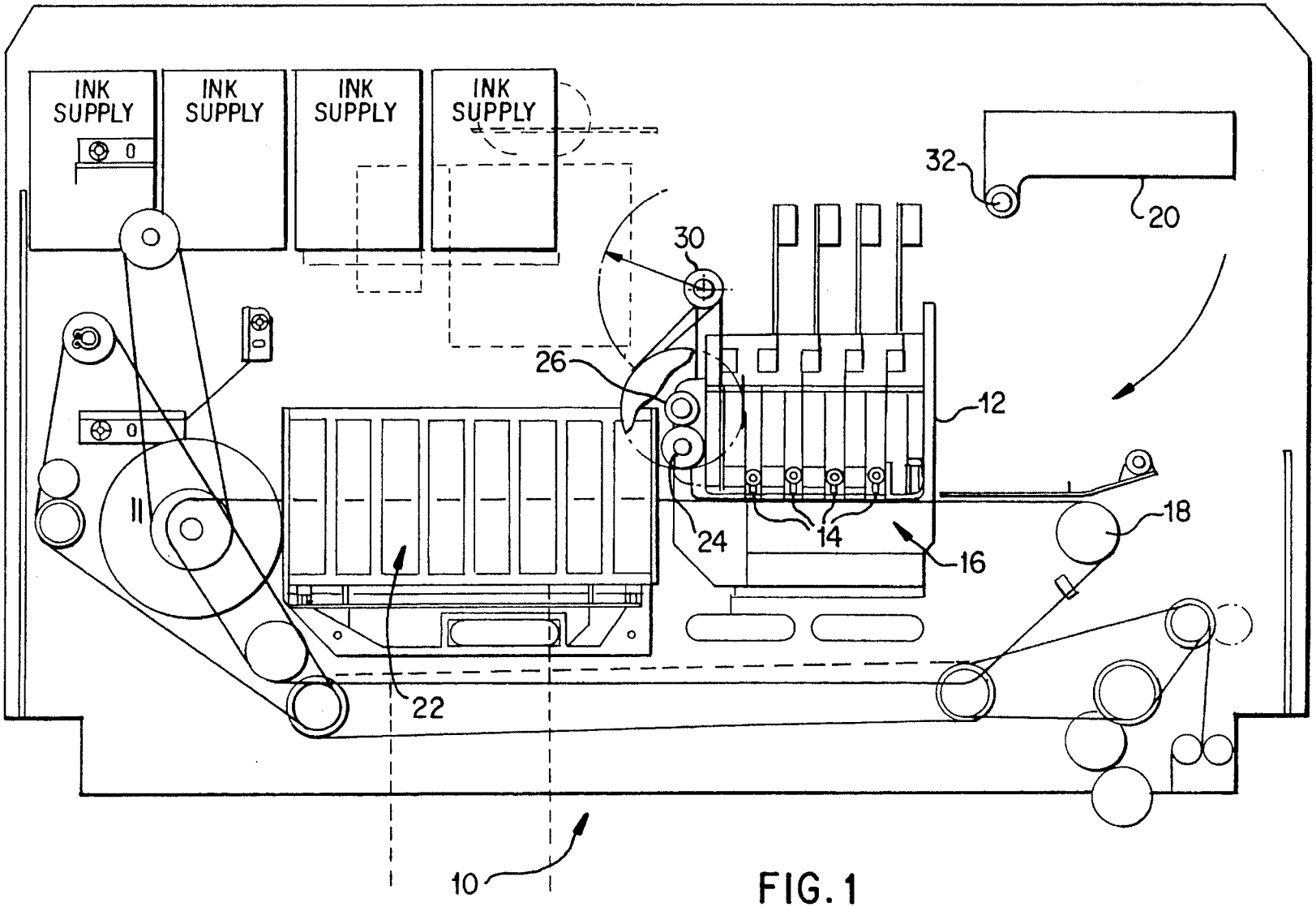
FIG. 1 is a side cut away view of internal printer components of a full width array ink jet printer according to a preferred embodiment of the invention with the full width printbar array in a vertical print position.
Figure 2:
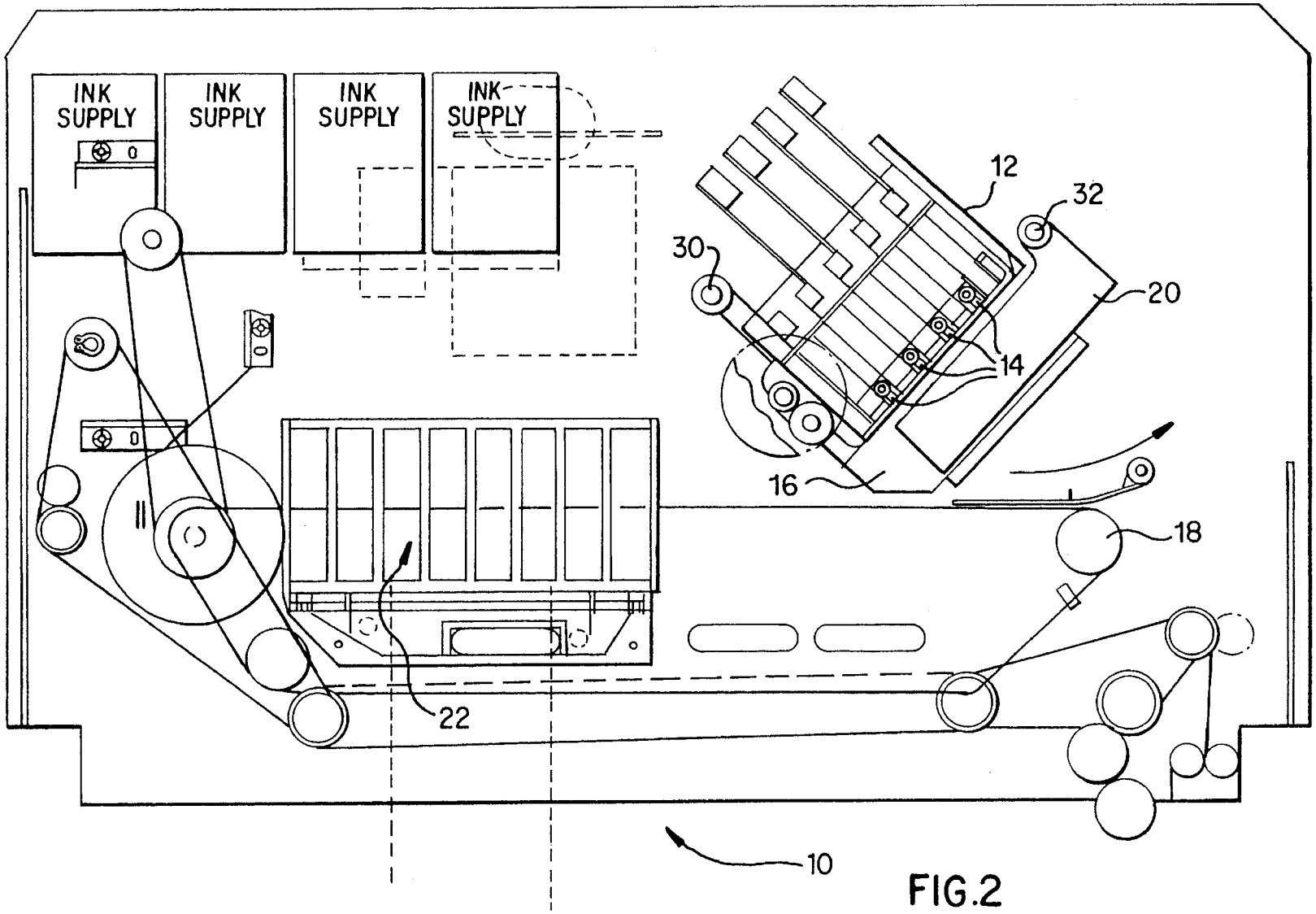
FIG. 2 is a side cut away view of FIG. 1 with the printbar in a rotated maintenance position.

With reference to FIGS. 1 and 2, there is shown a full width array thermal ink jet printer 10. The printer 10 includes a pivotal printbar frame 12, one or more full width printbars 14, maintenance carriage assembly 16, paper transport 18, movable cap assembly 20 and dryer 22. The maintenance carriage assembly 16 includes scan rail 24, lead screw 26, and stepper motor 28.

The printbar frame 12 is pivotal about a pivot axis 30 between a printing position (FIG. 1) and a maintenance position (FIG. 2), oriented angularly offset from the printing position away from the paper transport 18. The maintenance carriage assembly 16 is laterally movable along scan rail 24, parallel with the longitudinal axis of the printbars, to perform wiping and vacuum functions. The carriage assembly 16 also is movable to a home position which is outside of the length of the printbars 14 and paper transport 18, shown in FIG. 1 and more clearly shown in FIG. 6.

The cap assembly 20 is located adjacent the maintenance position of the printbars 14 in an otherwise unused portion of the printer housing. As shown, the cap assembly 20 can be positioned between a non-capping position displaced from the front face of the printbars and a capping position immediately contacting the front face of one or more printbars 14. While a preferred embodiment utilizes a cap assembly 20 that pivots about a cap pivot axis 32, the cap assembly 20 may be moved using linear motion such as that shown in FIGS. 3–5. In the preferred embodiment, the cap assembly is mounted to a shaft which serves as its rotational axis. There is a timing belt pulley rigidly attached to the shaft and another pulley rigidly mounted to the drive shaft of a DC stepper motor. The rotation is therefore accomplished through the use of a toothed timing belt. This motion could also be accomplished through the use of gears, direct mounting of the motor on the cap axis shaft, or through other linkages obvious to those skilled in the art. The stepper motor could be replaced by either an AC motor or a simple DC motor, with stop positions controlled through the use of end-of-travel sensors.

Figure 3:
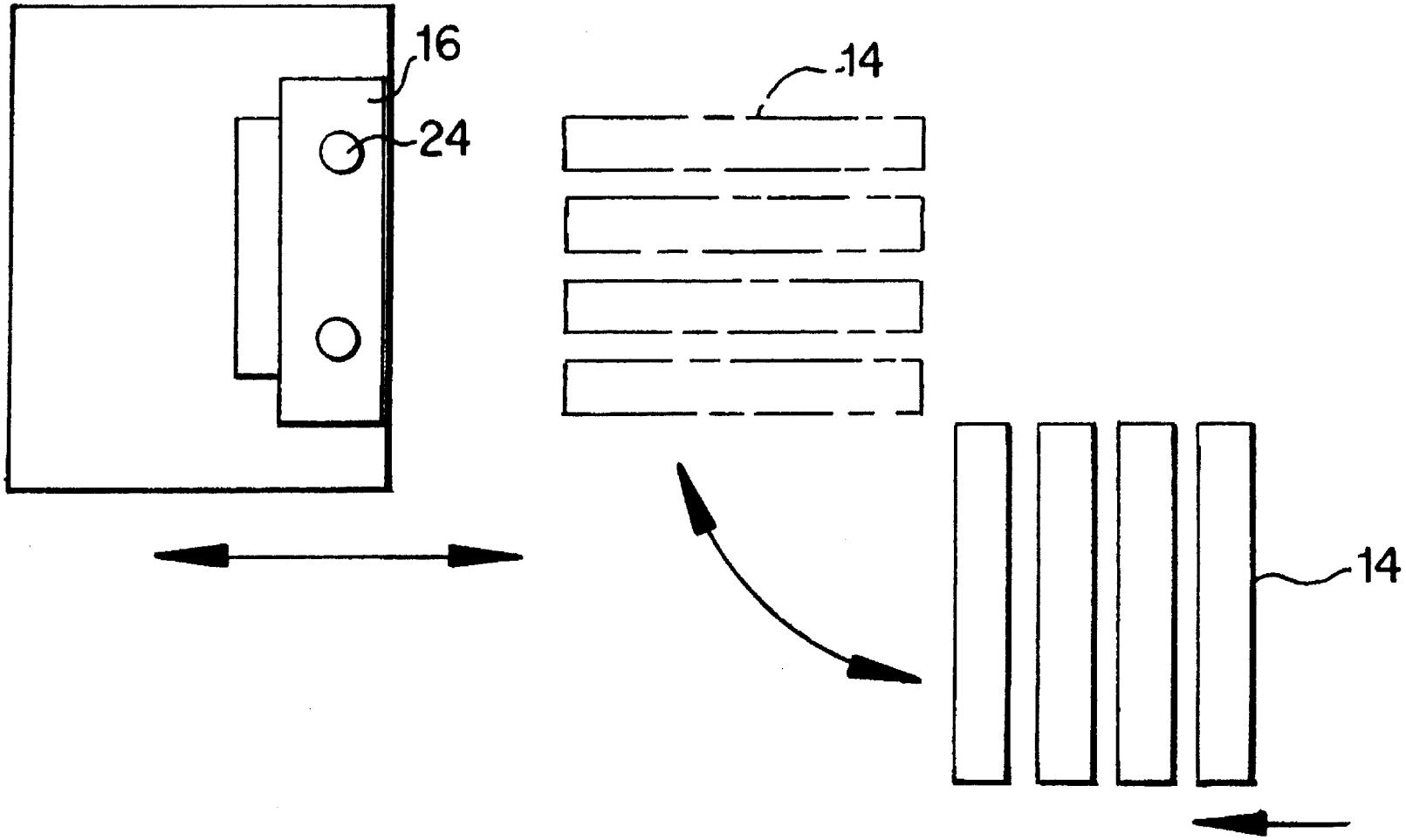
FIG. 3 shows a side view of printbar rotation about a pivot axis and translation of a maintenance capping member between first and second positions according to another embodiment of the invention.
Figure 4:
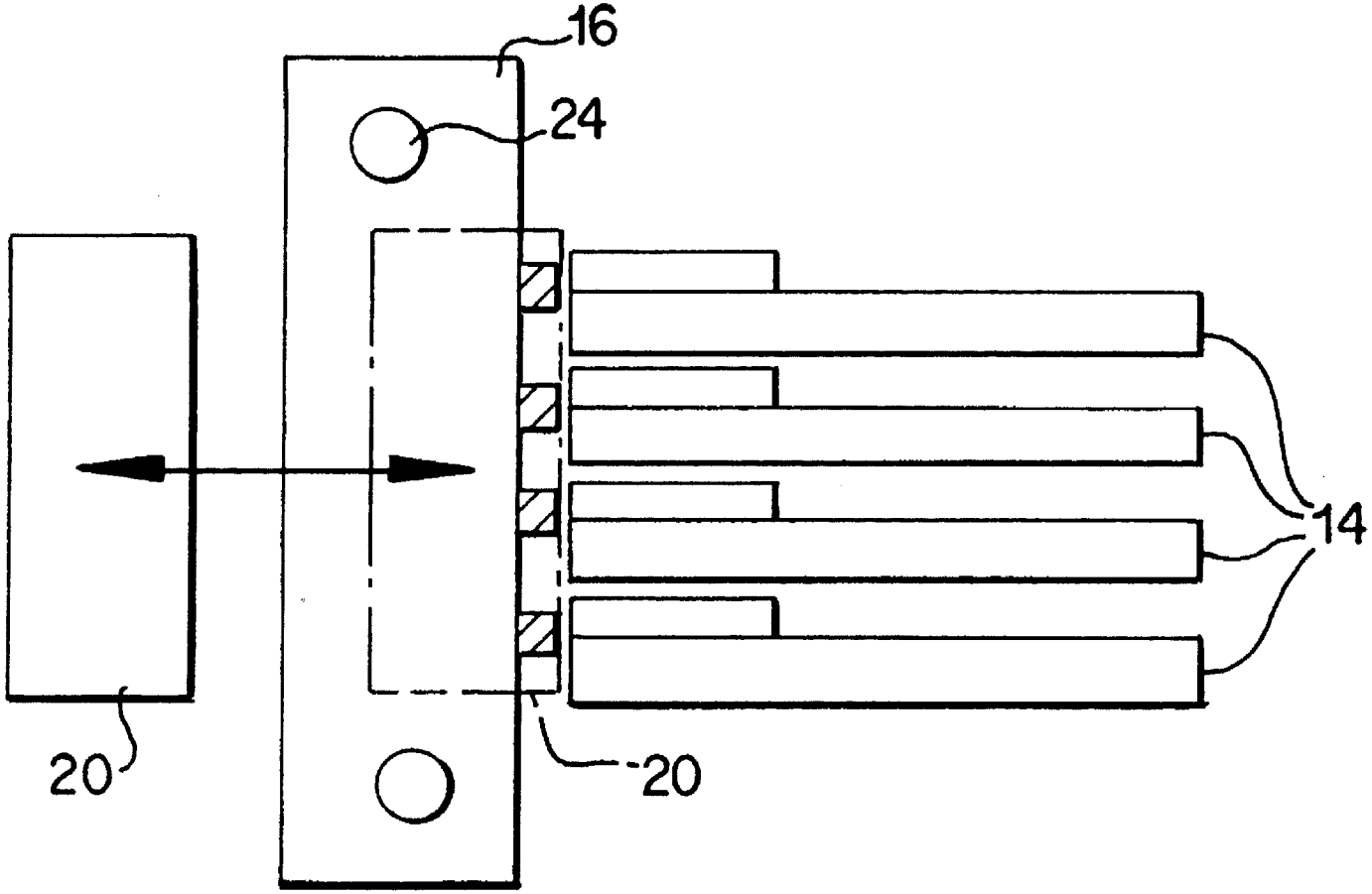
FIG. 4 shows a side view of a printbar and maintenance system of FIG. 3 when the printbar is in a maintenance position.
Figure 5:
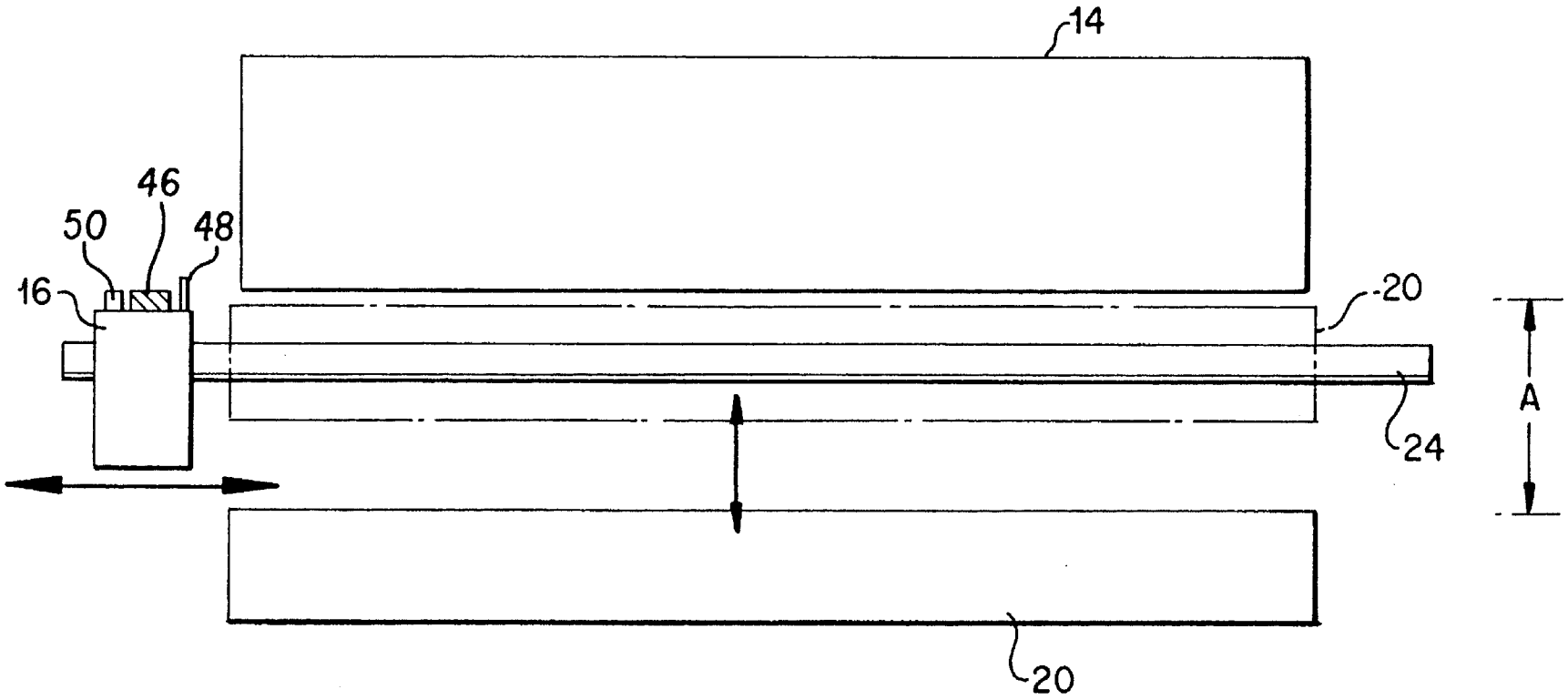
FIG. 5 shows a top view of the printbar and maintenance system components of FIG. 3.

With reference to a simplified embodiment shown in FIGS. 3–5, the printbar assembly, either individual printbars 14 or including printbar frame 12 (not shown), is rotated or translated to a maintenance position (shown in dashed form). In a preferred embodiment, that shown in FIGS. 1–2, the frame is rigidly mounted to the pivot axis shaft. At one end of the shaft is a gear segment that engages a gear on an AC drive motor. This gear segment is mounted to the shaft through a spring loaded mechanism, which allows a certain amount of over travel. The printbar frame is driven into hard stops in both the print (down) and maintenance (up) positions. Optical sensors are provided that shut off the current to the motor at the appropriate time. The compliance of the spring mechanism mounted to the gear segment allows for variations in motor coast and assures the printbar frame is always driven into the hard stop positions. In general, however, the printbar frame can be rotated through the use of a motor and some form of linkage. It is also contemplated that a single motor might rotate both the printbar and cap assemblies through the use of some four bar type linkage.

While in the maintenance position, a maintenance cap assembly 20 is moved linearly normal to the front face of the printbars 14 to mechanically engage and register with the front nozzle face of one or more printbars 14. This caps the front nozzle face of one or more printbars 14.

FIG. 5 shows a top view of the basic maintenance subsystem components, including the cap assembly 20, maintenance carriage 16 and scan rails 24. Because the maintenance carriage 16 must sweep across the front face, through the same volume occupied by the cap assembly 20 during capping, the cap assembly 20 must retract while wiping, vacuuming and drop sensing are performed. The cap assembly 20 can be moved, or remain, at a position spaced from the front nozzle face of the printbars 14 to provide a free space area A through which maintenance carriage assembly 16 can traverse. The free space area A must be sized to be of dimensions at least as great as dimensions of the maintenance carriage assembly 16. In FIG. 5, the cap assembly 20 is shown in a spaced position and a capping position (in dashed form) and the free space area A allows linear movement of the maintenance carriage assembly 16 across the front nozzle face of the printbars 15.

Because the full width array printbars 14 are fixed (as opposed to reciprocating), translation of a vacuum nozzle 46, wiper 48 and drop sensor 50 across the length of the printbar is accomplished using scanning maintenance carriage assembly 16. With some known systems, this placed burdensome constraints on the size and operation of the scanning maintenance assembly 16 because it was usually located within a paper transport endless belt or behind a document platen. As previously discussed, this required holes in the transport belt that would allow travel of the carriage assembly therethrough.

With this inventive maintenance arrangement, this is not necessary. By pivoting of the full width array printbars 14 to a position out of the way of the paper transport or other internal print components, there is virtually no restrictions on sizing and location of maintenance components such as carriage assembly 16 and cap assembly 20.

While FIG. 3 shows an approximately 90° angular relationship between the printing position and the maintenance position of printbars 14, the printbars can be pivoted either clockwise or counterclockwise any angular amount sufficient so long as to provide clearance of the cap assembly 20 and carriage assembly 16 from paper transport 18 or other various printer 10 components when operating on the front face of the printbars 14. The preferred embodiment shown in FIGS. 1–2 has an angular relationship of about 60° between the printing position and the maintenance position.

FIG. 4 show a side view of the printbar 14, cap assembly 20 and maintenance carriage assembly 16 relationships when the printbar is in the maintenance position. The scan rails 24 are shown and the cap assembly 20 is shown in both the capping position and a spaced position (in dashed form).

An additional advantage of all exemplary configurations described is that in these configurations, the maintenance subsystem and the printbars are located on the same side of the paper path. Therefore, in the event of a paper jam, the printbar frame is free to rotate up and cap with minimal potential of trapping the jammed sheet between the printbars and the cap. With the cost of the printbars estimated between $150–$200 and the potential for unrecoverable problems if left uncapped for extended periods, this is an important advantage over some other competitive concepts.

Figure 6:
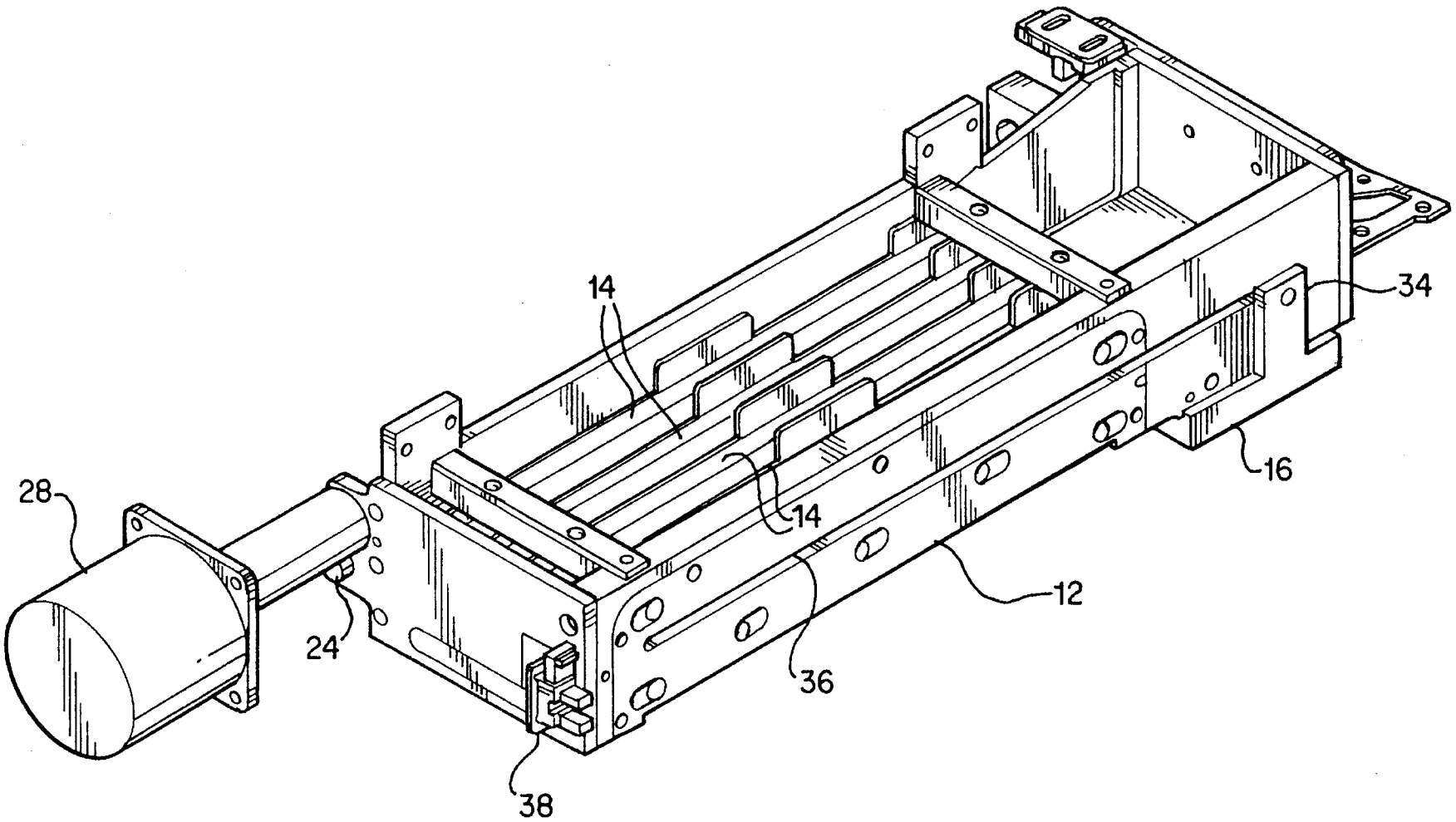
FIG. 6 is a perspective view of printbar frame components of FIG. 1.
Figure 7:
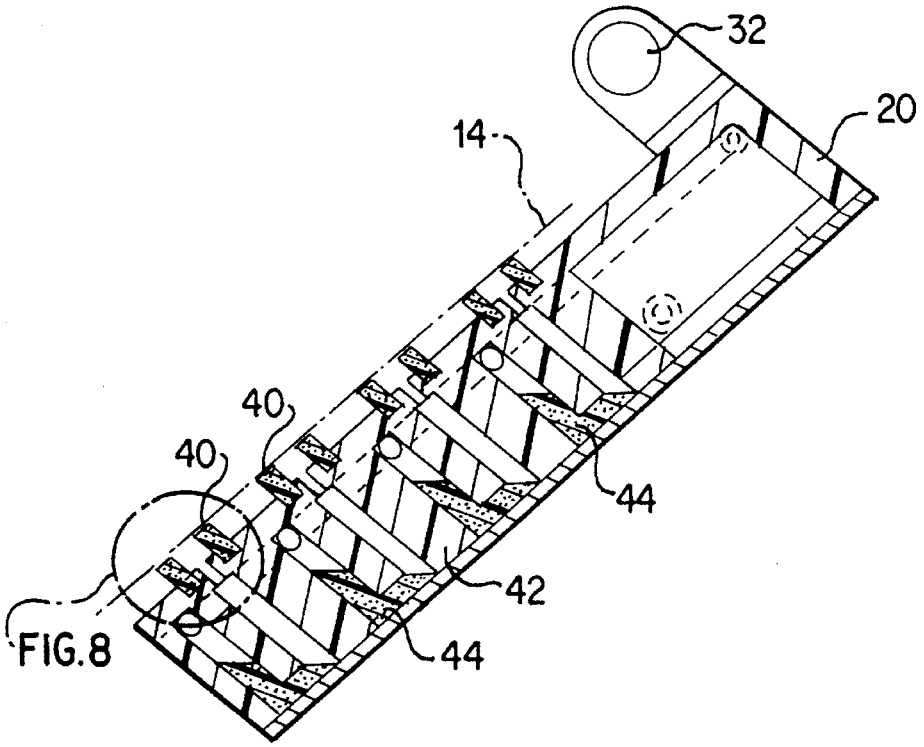
FIGS. 7 and 8 are a side sectional view and a partial enlarged view, respectively, of the cap assembly of FIG. 1.
Figure 8:
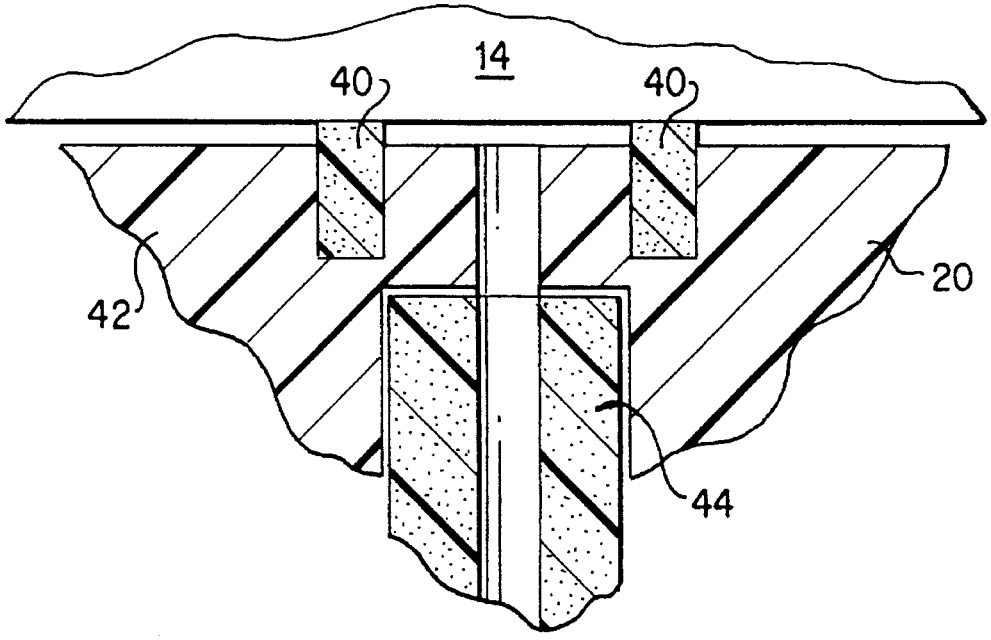

In the preferred configuration of the printer, shown in FIG. 1, a better understanding of the specific components can be made with reference to FIGS. 6–8. FIG. 6 shows the specific details of the printbar frame 12. Frame 12 is pivotal about frame pivot axis 30. Frame 12 contains and fixedly houses four printbars 14, one for cyan, yellow, magenta and black. The frame extends longitudinally beyond the length of the printbars 14 and allows maintenance carriage assembly 16 to traverse between a home position on one end of the frame to maintenance positions across the front nozzle face of the printbars 14.

Maintenance carriage assembly 16 is constrained by scan rail 24, an outboard stabilizer follower 34 and groove 36 within one side of frame 12. Assembly 16 is linearly movable across printbars 14 by stepper motor 28 through rotation of lead screw 26. An end of travel sensor 38 is also shown, for sensing and indicating when maintenance station 16 has extended to the end of the printbars 14 to provide full maintenance operation.

FIGS. 7–8 show a preferred configuration for cap assembly 20. The cap configuration consists of four foam capping gaskets 40 bonded to a plastic manifold 42. It is desirable to choose a gasket material that has high compliance, to reduce loading on the printbars 14, and low gas and vapor permeability. The manifold must also be highly impermeable. A preferred construction is EPDM rubber gaskets 40 bonded to a TEFLON manifold 42. Foam 44 may be provided and saturated with a maintenance fluid (water plus a biocide) to reduce evaporation of ink from the nozzles of printbar 14.

The invention has been described with reference to the preferred embodiments thereof, which are illustrative and not limiting. Various changes may be made without departing from the spirit and scope of the invention as defined in the appended claims.

What is claimed is:

1. A printing and maintenance system for an ink jet printer, comprising:

a printbar including a planar front nozzle face of a predetermined length defining a longitudinal axis of the printbar, the printbar being pivotally mounted for movement about an axis of rotation between a print position and a maintenance position, the maintenance position being angularly displaced from the print position; and a maintenance station translatable along an axis parallel to said longitudinal axis from an inactive position axially offset from said front nozzle face to an active position immediately in front of said planar front nozzle face when the print bar is in the maintenance position, said maintenance station comprising at least one maintenance device.

2. The printing and maintenance system of claim 1, wherein said maintenance station includes a vacuum nozzle.

3. The printing and maintenance system of claim 1, wherein said maintenance station includes a drop sensor.

4. The printing and maintenance system of claim 1, wherein said maintenance station includes a wiper blade.

5. The printing and maintenance system of claim 1, further including a scan carriage rail parallel to the longitudinal axis at least when said printbar is in the maintenance position for guiding and supporting said maintenance station as the maintenance station translates across said front nozzle face.

6. The printing and maintenance system of claim 1, wherein said print position provides the front nozzle face of said printbar substantially adjacent a paper transport path, while said maintenance position spaces the front nozzle face of said printbar sufficiently away from the paper transport path to allow complete operation of the maintenance station at any time.

7. A printing and maintenance system for an ink jet printer, comprising:

a printbar including a planar front nozzle face of a predetermined length defining a longitudinal axis of the printbar, the printbar being pivotally mounted for movement about an axis of rotation between a print position and a maintenance position, the maintenance position being angularly displaced from the print position;

a cap member for capping the front nozzle face, said cap member being independently positionable between a first position spaced from the front nozzle face and a second position in an area immediately in front of said front nozzle face with said cap member in direct engagement with said front nozzle face; and a maintenance station independently translatable along an axis parallel to said longitudinal axis through the area immediately in front of said planar front nozzle face from a position axially offset from said printbar when the printbar is in the maintenance position and the cap member is in the first position spaced away from the area, said maintenance station comprising at least one maintenance device and being mounted to said printbar for pivotal movement therewith between said print position and said maintenance position, said maintenance station being translatable across the predetermined length of said printbar front nozzle face.

8. The printing and maintenance system of claim 7, wherein said cap member is in the first position when said maintenance station is in an active position.

9. The printing and maintenance system of claim 7, wherein said cap member is positionable into the second position when said maintenance station is in an inactive position.

10. The printing and maintenance system of claim 7, wherein all of said printbar, said cap member and said maintenance station are on the same side of a paper path.

11. A method of performing a maintenance operation on an ink jet printbar having a planar nozzle face of a predetermined length defining a longitudinal axis, comprising the steps of:

(a) pivoting the printbar about an axis of rotation from a print position to a maintenance position offset from the print position;

(b) performing a maintenance operation on the printbar including translating a maintenance station from an inactive position axially offset from the predetermined length of the nozzle face along an axis parallel to the longitudinal axis across and immediately opposed to the nozzle face of the printbar; and (c) pivoting the printbar back to the print position.

12. The method of claim 11, wherein prior to step (c) a cap member is moved from an initially spaced position, away from the nozzle face of the printbar, to a capping position immediately opposed to and contacting with the nozzle face.

13. The method of claim 12, wherein the cap member is moved from the spaced position to the capping position through one of the group of pivotal movement and axial movement.

14. The method of claim 11, wherein said steps a–c are performed during a paper jam condition wherein paper is jammed in a paper path location immediately adjacent said printbar.

15. The method of claim 11, wherein step (b) subsequently includes translating the maintenance station back to the inactive position.

16. A printing and maintenance system for an ink jet printer, comprising:

a pivoting printbar frame;

a printbar including a planar front nozzle face of a predetermined length defining a longitudinal axis of the printbar, the printbar being mounted on said printbar frame for pivotal movement about an axis of rotation between a print position and a maintenance position, the maintenance position being angularly displaced from the print position; and a maintenance station mounted on said printbar frame for pivotal movement with said printbar, said maintenance station being translatable along an axis parallel to said longitudinal axis through an area immediately in front of said planar front nozzle face when the print bar is in the maintenance position, said maintenance station comprising at least one maintenance device.

17. The printing and maintenance system of claim 16, further comprising a scan carriage rail fixedly mounted on said printbar frame, said maintenance station being guided and supported for axial movement along said scan carriage rail.

* * * * *